US006488079B2

(12) United States Patent
Zifferer

(10) Patent No.: US 6,488,079 B2
(45) Date of Patent: Dec. 3, 2002

(54) CORRUGATED HEAT EXCHANGER ELEMENT HAVING GROOVED INNER AND OUTER SURFACES

(75) Inventor: L. Robert Zifferer, Waco, TX (US)

(73) Assignee: Packless Metal Hose, Inc., Waco, TX (US)

( * ) Notice: Subject to any disclaimer, the term of this patent is extended or adjusted under 35 U.S.C. 154(b) by 0 days.

(21) Appl. No.: 09/902,869

(22) Filed: Jul. 10, 2001

(65) Prior Publication Data

US 2002/0121361 A1 Sep. 5, 2002

Related U.S. Application Data

(60) Provisional application No. 60/255,801, filed on Dec. 15, 2000.

(51) Int. Cl.[7] ..... F28F 13/18

(52) U.S. Cl. ..... 165/133; 165/177; 29/890.053

(58) Field of Search ..... 165/177, 179, 165/183, 184, 133, 109.1; 29/890.045, 890.049, 890.053; 138/38, 168, 173, 163, 121

(56) References Cited

U.S. PATENT DOCUMENTS

| | | | | |
|---|---|---|---|---|
| 3,906,605 A | * | 9/1975 | Mclain | 165/183 |
| 4,248,179 A | | 2/1981 | Bonner | |
| 4,330,036 A | * | 5/1982 | Satoh et al. | 165/184 |
| 4,332,294 A | * | 6/1982 | Drefahl et al. | 165/177 |
| 4,365,487 A | * | 12/1982 | Dobney | 62/498 |
| 4,373,366 A | | 2/1983 | Tatsumi | |
| 4,377,083 A | | 3/1983 | Shepard et al. | |
| 4,437,329 A | | 3/1984 | Geppelt et al. | |
| 4,514,997 A | | 5/1985 | Zifferer | |
| 4,658,892 A | | 4/1987 | Shinohara et al. | |
| 4,690,211 A | * | 9/1987 | Kuwahara et al. | 165/184 |
| 4,715,436 A | * | 12/1987 | Takahashi et al. | 165/133 |
| 4,729,155 A | | 3/1988 | Cunningham et al. | |
| 4,866,830 A | | 9/1989 | Zohler | |
| 4,921,042 A | | 5/1990 | Zohler | |
| 5,092,038 A | | 3/1992 | Geppelt et al. | |
| 5,186,252 A | | 2/1993 | Nishizawa et al. | |
| 5,251,693 A | | 10/1993 | Zifferer | |
| 5,259,448 A | | 11/1993 | Masukawa et al. | |

(List continued on next page.)

FOREIGN PATENT DOCUMENTS

| | | |
|---|---|---|
| DE | 25 15 312 | 10/1976 |
| EP | 0 882 939 | 12/1998 |
| GB | 1 448 901 | 9/1976 |
| JP | 07-024522 | 1/1995 |

OTHER PUBLICATIONS

International Search Report for international application No. PCT/US01/48765 mailed Jul. 22, 2002.

*Primary Examiner*—Henry Bennett
(74) *Attorney, Agent, or Firm*—Erik B. Meyertons

(57) ABSTRACT

A corrugated heat exchanger element may have grooves and ribs on the interior and exterior surfaces of the tube. The corrugations on the tube may be linear corrugations or helical corrugations. The texturing of the interior and exterior surfaces of the tube, and the corrugations in the tube may provide a heat exchanger element that has a large surface area. The surface texturing and corrugations may also provide a heat exchanger element that promotes internal mixing of fluids that flow by and through the element. Increased internal mixing and increased surface area of an element may allow the heat exchanger element to have a high heat transfer coefficient. A heat exchanger element or heat exchanger elements may be assembled into a heat exchanger that has a high overall heat transfer coefficient. Ends of the heat exchanger element may be pointed to facilitate attachment of the element to a support structure.

49 Claims, 13 Drawing Sheets

U.S. PATENT DOCUMENTS 5,311,661 A * 5/1994 Zifferer ..... 29/890.053
5,351,397 A * 10/1994 Angeli ..... 29/890.053
5,388,329 A 2/1995 Randlett et al.
5,409,057 A 4/1995 Zifferer
5,415,225 A 5/1995 Randlett et al.
5,551,504 A 9/1996 Zifferer
5,573,062 A * 11/1996 Ooba et al. ..... 165/177
5,690,167 A * 11/1997 Rieger ..... 165/184
5,803,128 A 9/1998 Reed
5,813,438 A 9/1998 Reed
5,819,807 A 10/1998 Reed
5,992,512 A * 11/1999 Tsuri et al. ..... 165/133
5,996,686 A 12/1999 Thors et al.
6,056,048 A * 5/2000 Takahashi et al. ..... 165/184
6,067,712 A * 5/2000 Randlett et al. ..... 29/890.053

* cited by examiner

CORRUGATED HEAT EXCHANGER ELEMENT HAVING GROOVED INNER AND OUTER SURFACES

PRIORITY CLAIM

This application claims priority to U.S. Provisional Application No. 60/255,801 entitled "Corrugated Heat Exchanger Element Having Grooved Inner And Outer Surfaces," filed Dec. 15, 2000. The above-referenced provisional application is incorporated by reference as if fully set forth herein.

BACKGROUND OF THE INVENTION

1. Field of the Invention

The present invention generally relates to heat exchanger tubing. The present invention also generally relates to corrugated tubing having textured internal and external surfaces. The corrugated tubing may have linear or helical corrugations.

2. Description of Related Art

A heat exchanger tube may be used in a process that transfers heat between a first fluid inside the heat exchanger tube and a second fluid outside of the heat exchanger tube. The efficiency of heat transfer between the first fluid and the second fluid may be a complicated function that depends on the characteristics of the fluids, on the characteristics of the heat exchanger tube, and on the characteristics of fluid movement relative to the heat exchanger tube. The term "fluid" refers to a liquid, a gas, or a combination of a liquid and a gas. A heat exchanger tube may also be used to transfer heat between a fluid and a solid. The solid may be located inside or outside of the tube.

Each end of a tube may be pointed. A pointed tube may have reduced diameter cylindrical portions at each end of the tube that transition to a larger diameter main body section of the tube. Pointed tube ends may facilitate attachment of the tube to support structures. The support structures may be tube sheets of a heat exchanger. Tube sheets may support several tubes within a shell of a tube-and-shell heat exchanger. Fluid that is directed past outside surfaces of tubes of a tube-and-shell heat exchanger may flow in a direction that is substantially coaxial to a longitudinal axis of the shell of the heat exchanger. Tubes having pointed ends may be easier to position and seal to support structures than are tubes that do not have pointed ends. U.S. Pat. No. 5,311,661, which issued to Zifferer and which is incorporated by reference as if fully set forth herein, describes an apparatus that may be used to form heat exchanger tubes having pointed ends.

It is desirable to maximize the heat transfer rate across a wall of a tube of a heat exchanger. Increasing the surface area of a tube may increase the heat transfer rate across the tube. Also, directing fluid flow past and through a tube in desired fluid flow patterns may increase the heat transfer rate across the tube.

One method of increasing the surface area of a tube is to attach fins to an outer surface of the tube. Fins may be attached to a tube after the tube is formed, or fins may be formed in the outer surface of the tube. Fins may be formed on the outer surface of a tube by a finning tool of a finning machine. A finning tool typically includes three or four disks mounted on an arbor. The disks form a spiraled flight of fins on an outer surface of a tube during use. The fins formed by a finning tool may have heights that are greater than about 30 mils (0.030 inches). Generally, the fins formed by a finning tool are oriented substantially perpendicular to the longitudinal axis of the tube. A small amount of skew from a true perpendicular orientation allows the finning tool to provide a driving force to the tube that moves the tube through the finning machine.

Fins may be oriented substantially perpendicular to a longitudinal axis of the tube, or the fins may be oriented substantially parallel to the longitudinal axis of the tube. Fins on an outer surface of a tube that are substantially perpendicular to a longitudinal axis of the tube may be used in heat transfer applications where fluid flow is directed substantially perpendicular to the longitudinal axis of the tube. Heat exchanger tubes of condensers and evaporators may be finned tubes wherein the fins are oriented substantially perpendicular to longitudinal axes of the tubes. Fins that are oriented substantially parallel to a longitudinal axis of a tube may be used in heat transfer applications where fluid flow is directed substantially coaxial to the longitudinal axis of the tube. Tubes having fins that are oriented substantially parallel to longitudinal axes of the tubes may be used in tube and shell heat exchangers.

Fins on an outer surface of a tube may promote the development of areas that have little or no fluid movement when fluid flows by the tube. Such areas may develop on a side of a fin that is opposite to a direction of fluid flow past the tube if the fins of the tube are not oriented to allow fluid to flow adjacent to the tube. Such stagnant areas may decrease the heat transfer efficiency of a tube. Such stagnant areas may promote charring or thermal degradation of a heat transfer fluid.

Another method of increasing the surface area of a heat exchanger tube is to texture the inner surface of the tube. A knurling tool may be used to form a groove and rib pattern on an inner surface of a tube. The knurling tool may be placed within the tube. Force may be applied to an outer surface of the tube to press the inner surface of the tube against the knurling tool. Pressing the inner surface of the tube against the knurling tool forms a knurl pattern on the inner surface of the tube.

A finning tool and a knurling tool may be used in combination to form a tube that has a finned outer surface and a knurled inner surface. U.S. Pat. No. 4,886,830, which issued to Zohler and which is incorporated by reference as if fully set forth herein, describes a method of forming a tube that has a finned outer surface and a knurled inner surface.

An alternate method of texturing a tube is to form a desired pattern of ribs and grooves on surfaces of a flat metal plate. The plate may then be rolled into a cylindrical shape. A weld may be formed to join the ends of the plate together and form a tube. U.S. Pat. No. 5,388,329, which issued to Randlett et al., describes a method of manufacturing an extended surface heat exchanger tube using a rolled and welded metal plate.

Another method that may be used to increase the surface area of a tube is to corrugate or convolute the tube. The corrugations may be linear corrugations or helical corrugations. Linear corrugations may be formed in a tube by passing the tube through a corrugating die. The corrugating die may have angularly spaced die teeth that are positioned and shaped to progressively indent the wall of the tube at equally spaced points around the tube. U.S. Pat. No. 5,311,661 describes a system for forming linearly corrugated heat exchanger tubing.

Helical corrugations or convolutions may be formed in a tube by passing the tube through a corrugating die. A die and machinery used to produce a helically corrugated tube may be substantially the same as shown in U.S. Pat. Nos.

4,377,083, which issued to Dale et al.; 4,514,997, which issued to Zifferer; 5,409,057, which issued to Zifferer; and 5,551,504, which issued to Zifferer. Each of these patents is incorporated by reference as if fully set forth herein. Another method of forming helical corrugations in a heat exchanger tube is to heat and twist the tube as described in U.S. Pat. No. 4,437,329, which issued to Geppelt et al.

A heat transfer rate across a tube may be increased by directing fluid flow in a desired flow patterns through and by the tube. A desired flow pattern may increase internal mixing of a heat exchange fluid. A desired flow pattern may promote non-laminar fluid flow of one or both of the heat exchange fluids that flow by and through the tube. In a straight, smooth-walled cylindrical tube, fluid may flow past or through the tube in a laminar flow pattern. Laminar fluid flow may develop a boundary layer at a wall of the heat exchanger tube. The boundary layer may inhibit heat transfer throughout the fluid. Non-laminar fluid flow may minimize the formation of a boundary layer and promote internal mixing of the fluid so that heat transfer takes place throughout the fluid.

One method that may be used to obtain a desired fluid flow pattern is to change the geometrical configuration of the surfaces of a heat exchanger tube. The geometrical configuration of the surfaces of a heat exchanger tube may be changed by texturing the surfaces of the tube. Texturing the surfaces of the tube may increase the heat transfer surface area of the tube and promote internal mixing of fluid that flows through or by the tube.

Another method that may be used to obtain a desired fluid flow pattern is to corrugate the tube. The corrugations may be linear corrugations or helical corrugations. Linear corrugations may significantly alter the configuration of a tube so that non-laminar fluid flow is obtained for fluid flowing through and by the linearly corrugated tube. Helical corrugations may also significantly alter the configuration of a tube so that non-laminar fluid flow is obtained for fluid flowing through and by the helically corrugated tube. A helically corrugated tube may cause angular fluid flow by and through the tube. The angular fluid flow may cause internal mixing of the fluids flowing by and through the tube.

SUMMARY OF THE INVENTION

A corrugated heat exchanger element having textured inner and outer surfaces may be formed. The corrugations may be helical or linear corrugations. The texturing of the inner and outer surfaces may be patterns of grooves formed in the surfaces of the heat exchanger element. The heat exchanger element may have extended surface area. The heat exchanger element may also have surface features that result in desired flow patterns around and through the element. The extended surface area and surface features may provide improved heat transfer characteristics for a heat exchanger that includes textured and corrugated heat exchanger elements.

Inner and outer surfaces of a tube may be simultaneously textured with a texturing machine. The texturing machine may include an outer knurling device and an inner knurling device. The knurling devices may be used to form grooves in the inner and outer surfaces of a tube. Ribs may be formed in the tube surfaces between adjacent grooves. Heights of the ribs formed by the knurling devices may be less than about 35 mils (0.035 inches), and are preferably less than about 20 mils. The height of the ribs may be greater than about 4 mils. Heights have been expressed in terms of heights of the ribs, but the heights could also be expressed in terms of the depth of the grooves. For example, the depths of the grooves may range from about 35 mils to about 4 mils. The ribs formed in the outer surface of the tube may have a different height and a different pattern than the ribs formed in the inner surface of the tube. The ribs and grooves formed in the surfaces of the tube may increase the surface area of the tube, promote internal mixing of fluid that flows by or through the tube, and inhibit formation of stagnant areas of fluid adjacent to inner and outer surfaces of the tube.

The grooves and ribs may be formed in a helical pattern about a longitudinal axis of the tube. Texturing on an outer surface of a tube may be formed in a helical pattern by a texturing machine. An angle of the pattern relative to a longitudinal axis of the tube may be less than 90°, and is preferably less than about 45°. The angle of the pattern relative to the longitudinal axis of the tube is preferably greater than about 2°. Texturing on an inner surface of the tube may also be formed in a helical pattern. An angle of the inner tube surface pattern relative to a longitudinal axis of the tube may be less than about 90°, and may preferably be between about 5° and 45°, and may more preferably be about 30°. The patterns of ribs and grooves in the inner and outer surfaces of a tube may be formed at angles less than 45° so that the tube may be used as a heat exchanger element wherein fluid flows by and through the tube in directions that are substantially coaxial to the longitudinal axis of the tube.

An embodiment of a texturing machine may be used to form an angle pattern in an outer surface of a tube that is oriented in an opposite direction to an angle of a pattern formed in an inner surface of the tube. For example, a pattern formed in an outer surface of a tube may be a 20° right-hand helical pattern of ribs and grooves, while a pattern formed in an inner surface of the tube may be a 30° left-hand helical pattern of ribs and grooves. In an alternate embodiment, the pattern orientation in the outer tube surface may be formed in a left-hand helical pattern, and the pattern orientation in the inner tube surface may be formed in a right-hand helical pattern. The oppositely oriented patterns may cause the formation of a cross-knurled pattern in the outer and inner surfaces of the tube. The cross-knurled pattern may be a result of grooves being formed in the outer surface when ribs are formed on the inner surface. Similarly, grooves may be formed in the inner surface when ribs are formed on the outer surface. Embodiments of texturing machines may form helical patterns in tubing that are in the same orientation. For example, a helical pattern in inner and outer tube surfaces may be oriented in a right-hand helical pattern. A helical pattern in inner and outer tube surfaces may also be oriented in a left-hand helical pattern.

A tube that is to be textured by a texturing machine may be placed over a mandrel of the machine so that a portion of a first end of the tube extends beyond the outer knurling device. The outer knurling device may be pressed against the tube to press an inner surface of the tube against the inner knurling device. A drive or drives may be engaged to move the tube through the machine so that the knurling devices form textured inner and outer tube surfaces. The drive or drives may be disengaged before the outer knurling device reaches a second end of the tube. Placing a portion of the first end of the tube beyond the outer knurling device and disengaging the knurling machine before reaching the second end of the tube leaves un-textured portions of tubing at each end of the tube. Un-textured portions of tube may allow the tube to be easily attached and sealed to support structures. The support structures may be tube sheets of a heat exchanger.

Each end of a textured tube may be pointed by a pointing machine to promote easy attachment of the tube to support structures. To point an end of a tube, the end of the tube may be brought into contact with a tube-pointing die. The tube-pointing die may form a frustro-conical section and a reduced diameter, cylindrical section.

A corrugating machine may corrugate a textured tube. In one embodiment, a corrugating machine forms linear corrugations in a textured tube to produce a heat exchanger element. In another embodiment, a corrugating machine forms helical corrugations in a textured tube to produce a heat exchanger element. A corrugating machine may form 3 to 20 corrugations in a textured tube that initially started as a 1 ½ inch diameter un-textured tube. Preferably, a corrugating machine forms 4 to 8 corrugations in a textured tube. A corrugating machine may include a corrugating die and a tube driving mechanism. A corrugating die of a helically corrugating machine may be rotatively mounted within the corrugating machine. The drive mechanism, which may include two independent units, may initially drive a tube into a corrugating die, and then pull the tube through the die.

An advantage of a corrugated and textured heat exchanger element may be that the element has extended surface area. Both the corrugations and the texturing of the inner and outer surfaces of the heat exchanger element may increase the surface area of the element. Another advantage of a corrugated and textured heat exchanger element may be that the textured surfaces and the corrugations promote desired fluid flow patterns through and by the element. The texturing on the outer and inner surfaces of the heat exchanger element may promote internal mixing of fluid that flows adjacent to the element. The internal mixing of the fluids may inhibit fouling and plugging within and adjacent to the heat exchanger element. Corrugations in a heat exchanger element may significantly change the fluid passageways through and by the element so that non-laminar fluid flow patterns develop within the element even at relatively low fluid flow rates through the element.

Another advantage of a textured and corrugated heat exchanger element may be that the element includes un-textured, reduced diameter, cylindrical portions at each end of the element. The un-textured and cylindrical portions may allow the heat exchanger element to be easily and conveniently sealed to support structures. The support structures may be tube sheets of a heat exchanger. A heat exchanger element may be sealed to a support structure by a sealing method. Sealing methods include, but are not limited to, welding or application of sealant. Attaching a heat exchanger element that has un-textured ends to a support structure may be easier to accomplish than attaching an element with textured ends because special measures do not have to be implemented to ensure that a seal is formed adjacent to each groove of the texturing in the element.

Another advantage of a textured and corrugated heat exchanger element may be that the corrugations and the formation of cylindrical portions at the ends of the element result in an element that has increased structural strength as compared to a cylindrical tube. The increased structural strength may inhibit bending and deformation of the heat exchanger element during assembly of the element into a heat exchanger. Other advantages of a textured and corrugated heat exchanger element may include that the element is sturdy, durable, simple, efficient, reliable and inexpensive; yet the heat exchanger element is also easy to manufacture, install, maintain and use.

BRIEF DESCRIPTION OF THE DRAWINGS

Further advantages of the present invention will become apparent to those skilled in the art with the benefit of the following detailed description of embodiments and upon reference to the accompanying drawings in which.

Figures 1, 2:
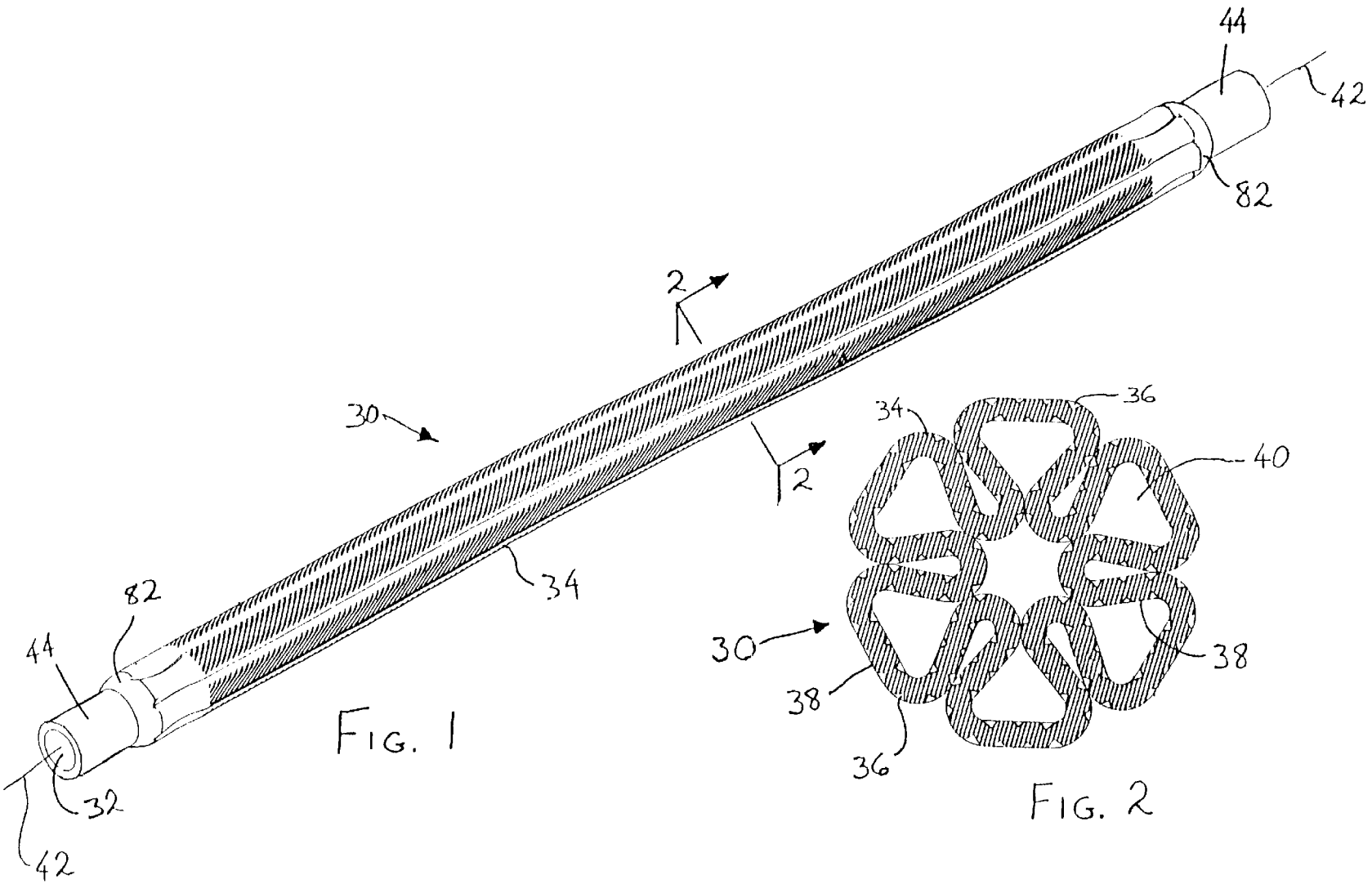
FIG. 1 shows a perspective view of a textured and linearly corrugated tube.
FIG. 2 shows a cross sectional view of the linearly corrugated tube taken substantially along plane 2—2 of FIG. 1.

While the invention is susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents and alternatives falling within the spirit and scope of the present invention as defined by the appended claims.

DESCRIPTION OF THE PREFERRED EMBODIMENTS

Figure 3:
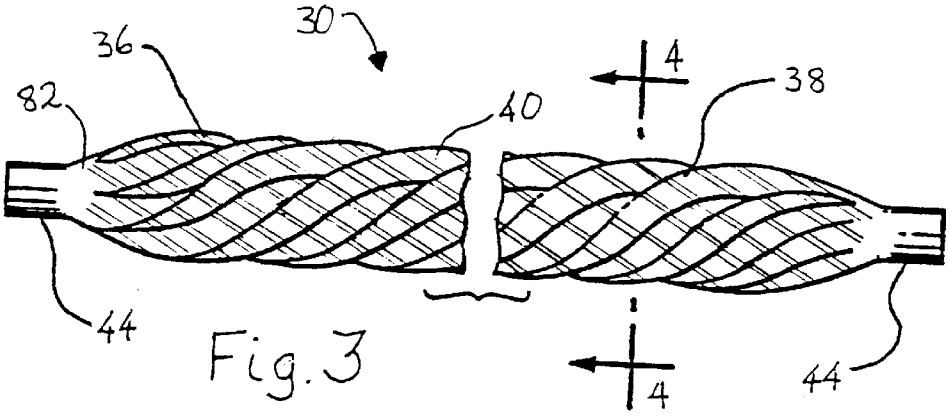
FIG. 3 shows a front view of a textured and helically corrugated tube.
Figure 4:
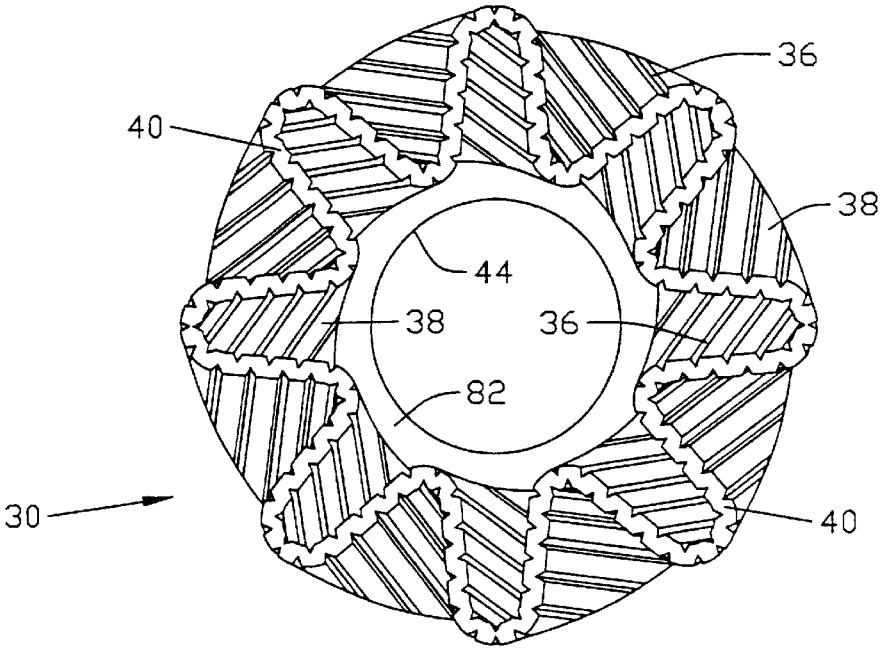
FIG. 4 shows a cross sectional view of the helically corrugated tube taken substantially along line 4—4 of FIG. 3.

FIGS. 1–4 show embodiments of textured, corrugated heat exchanger elements 30. Inner surfaces 32 and outer surfaces 34 of the elements 30 may be textured. The texturing of the inner and outer surfaces 32, 34 may be a pattern of grooves 36 formed in the surfaces of the elements 30. Forming grooves 36 in the surfaces 32, 34 may result in the formation of ribs 38 between adjacent grooves. An element 30 may be corrugated. The corrugations may form a number of lobes 40 about longitudinal axis 42 of the element. The corrugations may be linear corrugations. Linearly corrugated elements 30 have lobes 40 that run substantially along longitudinal axes 42 of the elements. FIGS. 1 and 2 show embodiments of textured and linearly corrugated elements 30. Helically corrugated elements 30 have lobes 40 that spiral about the longitudinal axes 42 of the elements. FIGS. 3 and 4 show embodiments of textured and helically corrugated elements 30.

A textured and corrugated heat exchanger element 30 may have a large heat transfer surface area as compared to cylindrical heat exchanger elements. A textured and corrugated heat exchanger element 30 may also promote internal mixing of fluids that flow through and by the element. An element 30 may also include cylindrical end sections 44. The end sections 44 may include outer surfaces 34 that are un-textured. The end sections may also include inner surfaces 32 that are un-textured. The end sections 44 may allow the element to be easily coupled and sealed to a support structure. Corrugations in the element 30 may provide the element with an increased moment of inertia as compared to a cylindrical tube having substantially the same wall thickness and cross sectional area. The increased moment of inertia may provide the element 30 with increased structural strength and resistance to axial bending.

Figure 5:
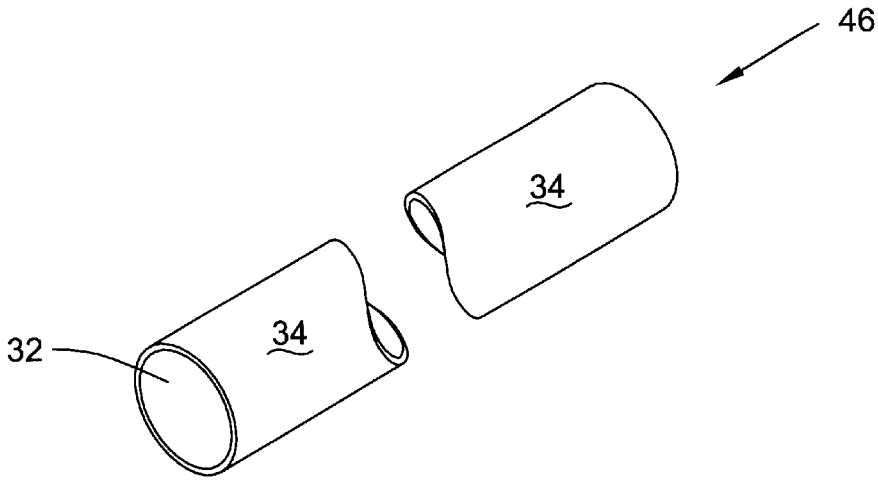
FIG. 5 shows a perspective view of a cylindrical tube that may be used as a blank during formation of a textured tube.

Cylindrical tubing stock 46 may be used as a starting material to form a corrugated heat exchanger element 30. FIG. 5 shows a tube 46 that may be used to form a corrugated heat exchanger element 30. The cylindrical tube 46 may have an outer diameter that is greater than about ⅜ inches. The outer diameter of a tube 46 may be reduced during transformation of the tube into a textured heat exchanger element 30. Corrugations in the element 30 may transform the tube 46 into a shape that has an effective diameter. For example, a 1 ½ inch outer diameter tube 46 may be reduced to about a ⅝ inch diameter element 30 when the tube is transformed to a 6-lobed linearly corrugated, textured heat exchanger element 30. Reducing from a 1 ½ inch to a ⅝ inch diameter element is a 2.4 to 1 diametric reduction. In addition to reducing a diameter of the cylindrical tube stock 46, a length of the cylindrical tube may also be reduced when the tube is transformed into a heat exchanger element 30.

In certain embodiments, the cylindrical tubing stock 46 may be made of a high thermal conductivity metal; including, but not limited to, copper, brass, or aluminum. In other embodiments, the cylindrical tubing stock 46 may be made of a corrosion resistant metal; including, but not limited to, stainless steel, nickel, nickel alloys, titanium, or titanium alloys. To enhance the ease of fabrication of a textured, corrugated heat exchanger element 30, the tubing stock 46 preferably has a thin wall thickness. The tubing material may be chosen based upon a number of factors including, but not limited to, material cost, required heat transfer rate across the tubing, and corrosive properties of fluids that contact the tubing.

To transform cylindrical tubing stock 46 into a textured, corrugated heat exchanger element 30, the tubing stock may be subjected to a number of processes. The processes may include a texturing process, a pointing process, and a corrugating process. The texturing process may produce textured tube 48 with inner and outer surfaces 32, 34 that are textured. The pointing process may reduce the diameter of end portions to produce a tube having reduced diameter, cylindrical end portions 44. The corrugating process may produce corrugations in the textured and pointed tube 48. The corrugations may be linear corrugations or helical corrugations.

Figure 6:
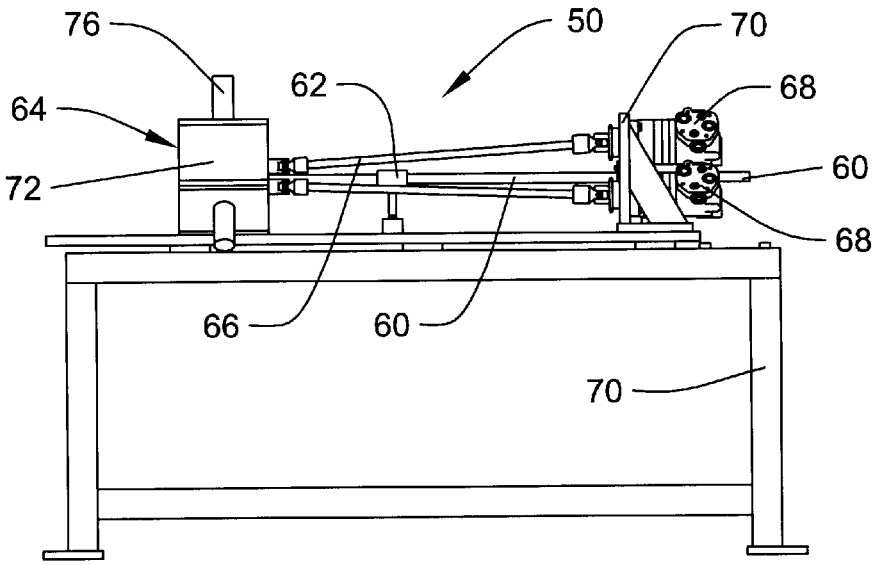
FIG. 6 shows a diagrammatic representation of a texturing machine.
Figure 7:
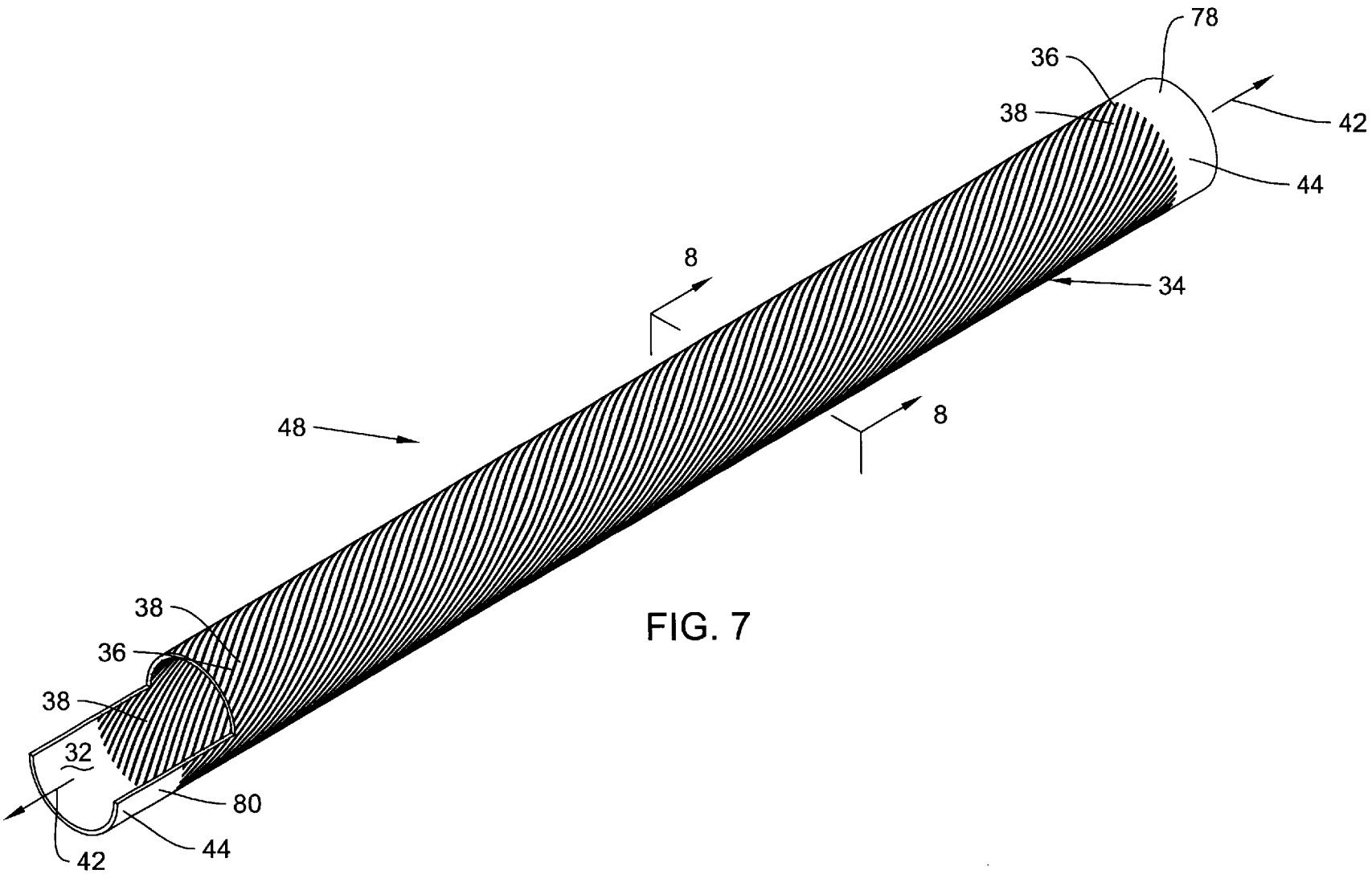
FIG. 7 shows a perspective view of a textured tube, including a cut away portion that shows texturing on an inner surface of the tube.
Figure 8:
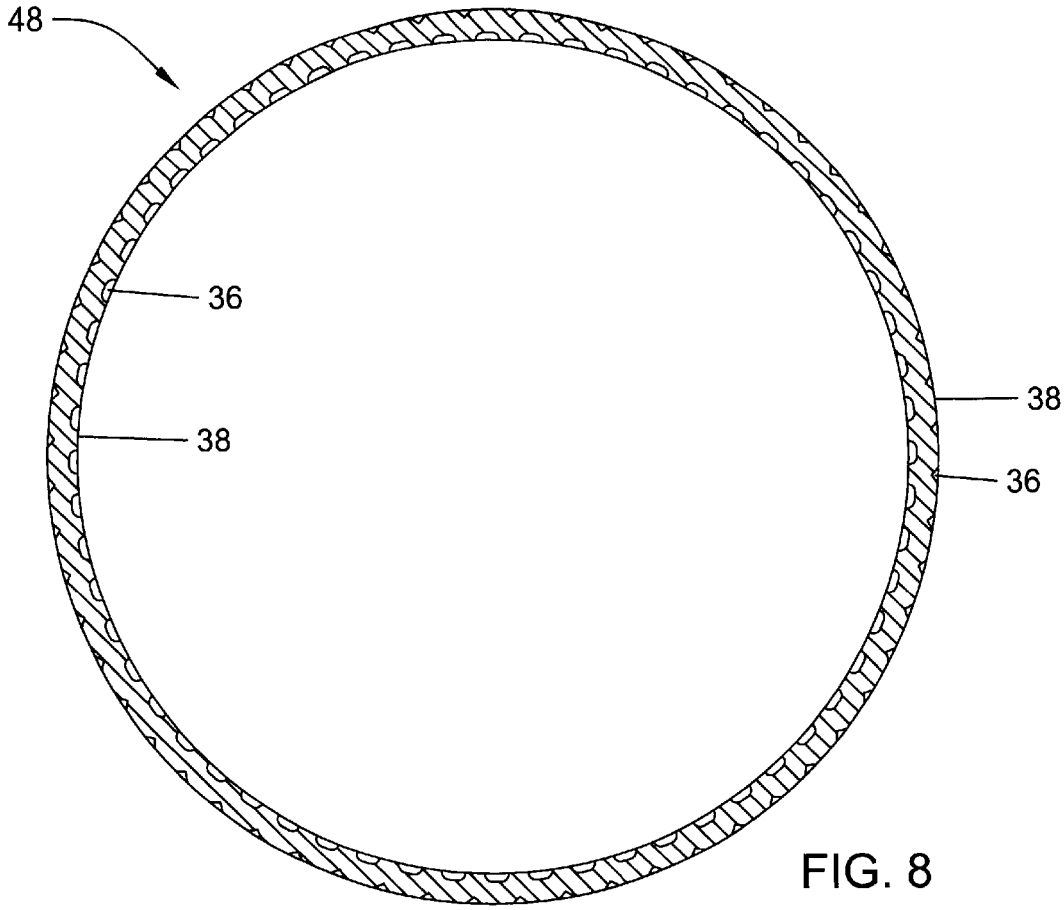
FIG. 8 shows a cross sectional view of the textured tube, taken substantially along plane 8—8 of FIG. 7.

In an embodiment, cylindrical tubing stock 46 may be textured with a texturing machine 50. FIG. 6 shows a representation of a front view of a texturing machine 50. The texturing machine 50 may be used to texture both inner surface 32 and outer surface 34 of a tube 46. FIG. 5 shows a perspective view of a cylindrical tube 46 that may be used as a starting blank for formation of a textured tube 48. FIG. 7 shows a representation of textured tube 48. A portion of the tube 48 is cutaway to show the texturing of the inner surface 32 of the tube. FIG. 8 shows a cross sectional view of the tube 48.

A texturing machine 50 may simultaneously texture both an inner surface 32 and an outer surface 34 of a tube 46. The texturing formed in the inner and outer surfaces 32, 34 may be helically formed patterns of grooves 36. The angle of the helical pattern of grooves 36 in the inner surface 32 of a textured tube 48 relative to a longitudinal axis 42 of the tube may be less than 90°, and preferably less than 45°, and most preferably about 30°. The angle of the helical pattern of grooves 36 in the outer surface 34 of the tube 48 relative to the longitudinal axis 42 of the tube may be less than 90°, and preferably less than about 45°, and most preferably less than about 30° and greater than about 2°.

The angle pattern of textured inner surface 32 may be substantially the same as the angle pattern formed in textured outer surface 34. Alternately, the angle pattern of textured inner surface 32 may be may be unequal to the angle pattern of outer textured surface 34. For example, the inner surface 32 may have an angle pattern of 30° relative to a longitudinal axis 42 of the tube 48, and the outer surface 34 may have an angle pattern of 20° relative to the longitudinal axis of the tube. The helical pattern formed by a texturing machine 50 in an inner surface 32 of a tube 46 may be in a right-handed helical orientation or a left-handed helical orientation. Similarly, the helical pattern formed by a texturing machine 50 in an outer surface 34 of a tube 46 may be in a right-handed helical orientation or a left-handed helical orientation. The helical patterns formed in the inner surface and outer surface 32, 34 of a tube 48 may both have the same orientation. For example, the helical pattern formed in the inner and outer surfaces 32, 34 may both have right or left-handed helical orientations. FIG. 7 shows a tube 48 wherein the helical pattern formed in the inner surface 32 and the outer surface 34 of the tube are oriented in the same direction.

Figure 9:
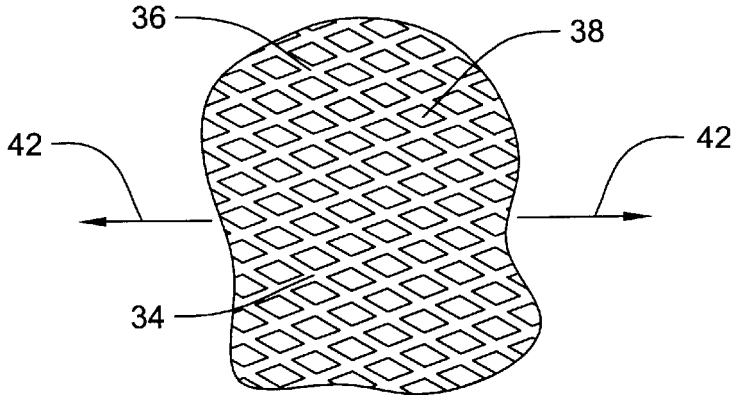
FIG. 9 shows an outside portion of a textured outside surface of a tube wherein the helical pattern formed in the outer surface of the tube is formed in a direction that is opposite to the direction of the helical pattern formed in the inner surface of the tube.

Alternatively, a helical pattern formed in a textured inner surface 32 may be oriented opposite to a helical pattern formed in a textured outer surface 34. For example, the helical orientation of the inner surface 32 may be a right-hand helical orientation while the helical orientation of the outer surface 34 may be a left-hand helical orientation. Similarly, the helical orientation of the inner surface 32 may be a left-hand helical orientation while the helical orientation of the outer surface 34 may be a right-hand helical orientation. The opposite helical orientations may produce a crosshatched pattern in the surfaces 32, 34 of the tube 48. FIG. 9 shows a representation of a portion of an outer surface 34 of a tube 48 wherein the texturing machine 50 produced oppositely oriented helical orientations in the inner and outer surfaces 32, 34.

A height between a bottom of a groove 36 and a top of a rib 38 of a surface 32 or 34 that is textured may be less than about 35 mils, may preferably be less then about 25 mils, and may be more preferably less than about 20 mils. The height between a bottom of a groove 36 and a top of a rib 38 may be greater than about 4 mil. In an embodiment, the height of the ribs 38 formed in the outer surface 34 may be substantially the same as the height of the ribs formed in the inner surface 32. In an alternate embodiment, the height of the ribs 38 formed in the outer surface 34 may be different than the height of the ribs formed in the inner surface 32. For example, FIG. 8 shows an embodiment of a tube 48 wherein the height of the ribs 38 in the outer surface 34 are of a height, which may be about 12 mils, which is different than a height of the ribs formed in the inner surface 32, which may be about 20 mils.

Figure 10:
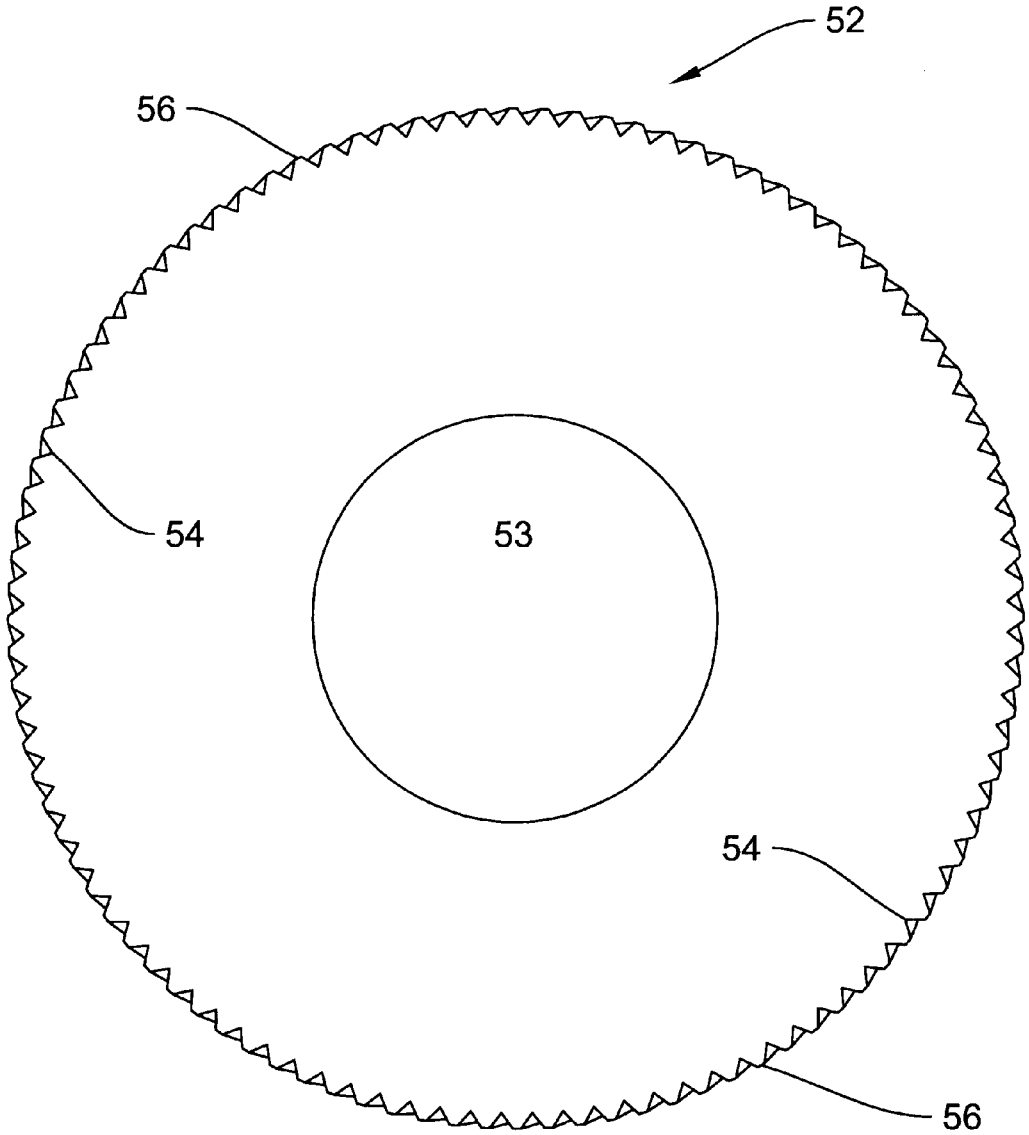
FIG. 10 shows an end view of an embodiment of an inner knurling tool.

A pattern formed in an inner tube surface 32 may be formed by inner knurling tool 52 of a texturing machine 50. FIG. 10 shows an end view of an embodiment of an inner knurling tool 52. The knurling tool 52 may include a bore 53 through the longitudinal axis of the cylinder that allows the knurling tool to be coupled to the texturing machine 50. A pattern formed in the outer surface 34 of a textured tube 48 may be formed by outer knurling tool 58, or by outer knurling tools. An outer knurling tool 58 may substantially resemble an inner knurling tool 52. The geometric properties of the knurling tools 52, 58, such as outer diameter and length, may differ. The knurling tools 52, 58 form ribs 38 and grooves 36 in inner and outer surfaces 32, 34 of the tube 46 in opposite patterns to the patterns of grooves 54 and ribs 56 formed in the surfaces of the knurling tools 52, 58. The knurling tools 52, 58 may be made of materials that are harder than the material of the tube 46 being textured. For example, the knurling tools 52, 58 may be formed of C2 carbide and the tube 46 may be formed of copper.

A knurling tool 52 or 58 may include a large number of grooves 54 and ribs 56 in an outer surface of the tool. In an embodiment, an inner knurling tool 52 and an outer knurling tool 58 for a 1 ½" diameter tube 46 each form 80 ribs 38 in the circumference of the tube during texturing. Knurling tools 52 or 58 that form fewer or more ribs 38 in a tube 46 may also be used. Also, a different number of ribs 38 may be formed in an outer surface 34 of a tube 46 than are formed in an inner surface of the tube 32.

Different knurling tools 52, 58 may be interchangeable positioned within a texturing machine 50. The ability to use different knurling tools 52, 58 within a texturing machine 50 may allow textured tubes 48 to be formed that have different rib heights, different angle patterns, and/or different helical pattern orientations. Tubes 48 with different rib heights, angle patterns, and/or different helical pattern orientations may be needed for different heat transfer applications.

The inner knurling tool 52 and the outer knurling tools 58 may be configured to form different types of grooves 36 and ribs 38. For example, in an embodiment of a texturing machine 50, the inner knurling tool 52 may be configured to form substantially "U" shaped grooves 36, while the outer knurling tool 58 may be configured to form substantially "V" shaped grooves. FIG. 8 shows an embodiment of a textured tube 48 wherein the knurling tools 52, 58 formed grooves 36 and ribs 38 of different shapes in the tube.

FIG. 6 shows a view of texturing machine 50 that may be used to form a textured tube 48. The machine 50 may include mandrel 60, tube support 62, head 64, drive shafts 66 and drives 68. The machine 50 may also include a cooling system (not shown) that inhibits overheating of the machine and a tube 46 during formation of a textured tube 48. The cooling system may direct a stream of coolant against the tube 46 and portions of the head 64 to cool and lubricate the machine 50 and the tube. The coolant may splash against an inner surface of the head 64. The coolant may flow by gravity to a collection pan below the head 64.

A mandrel 60 may be a guide and support for a tube 46 that is positioned within a texturing machine 50. A mandrel 60 may be a tube or rod with an inner knurling tool 52 rotatively mounted to the tube or rod near a first end of the mandrel. A second end of the mandrel 60 may be fixedly attached to support structure 70 of the texturing machine 50. The knurling tool 52 may have a diameter that is slightly less than a diameter of the tube 46 to be textured. The mandrel 60 may position the inner knurling tool 52 centrally within the head 64. A user may slide a tube 46 that is to be textured over the inner knurling tool 52 and mandrel 60 so that the knurling tool supports a portion of the weight of the tube. Also, the tube 46 may be partially supported by a tube support 62.

Figure 11:
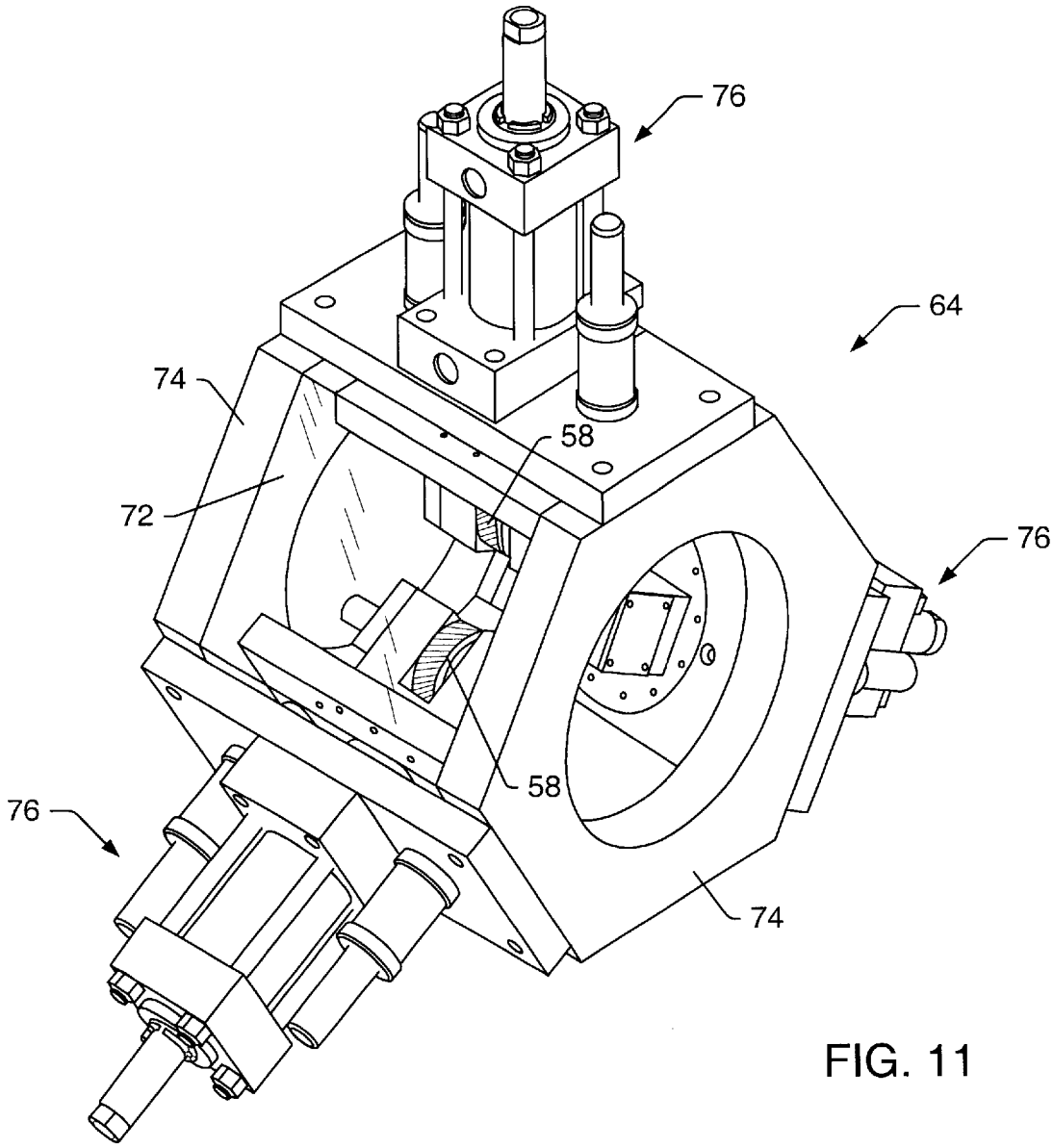
FIG. 11 shows a perspective view of an embodiment of a head of a texturing machine.
Figure 12:
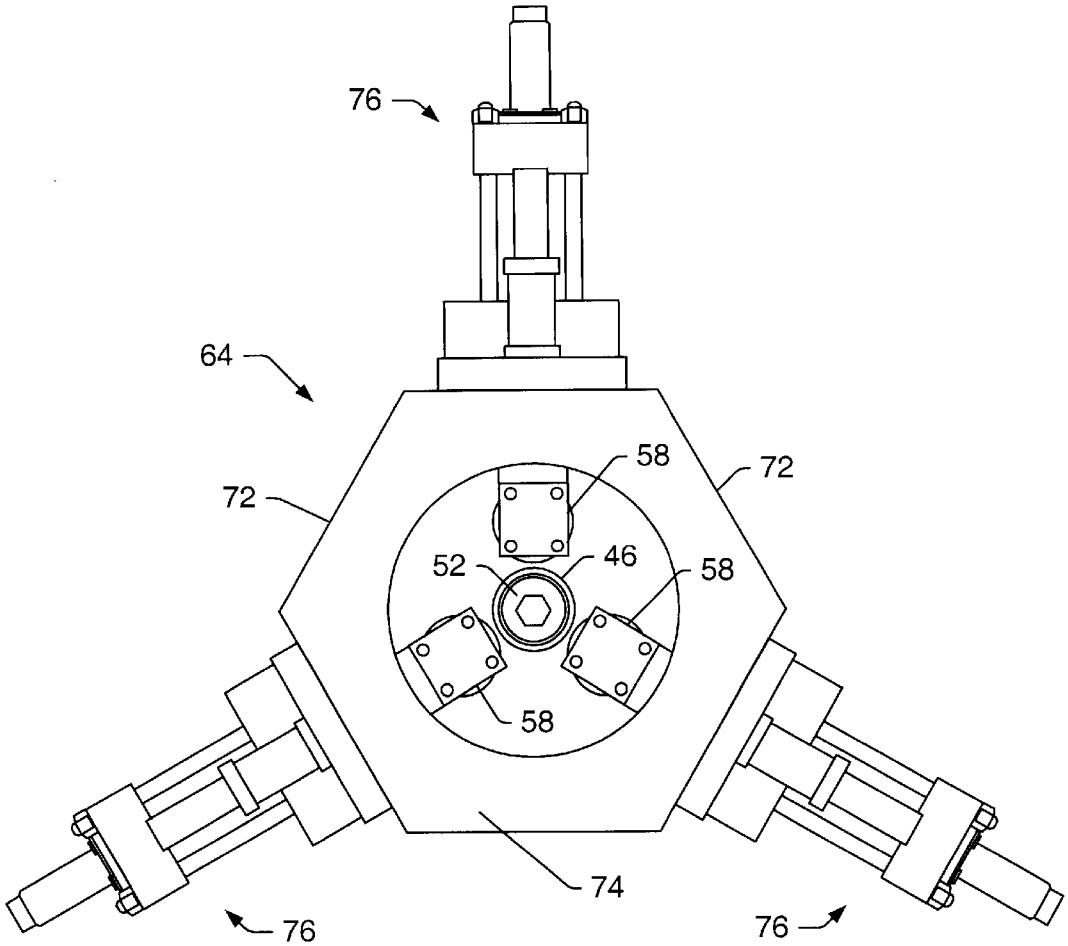
FIG. 12 shows an end view of an embodiment of a head of a texturing machine, with a mandrel and tube centrally positioned within the head.

A head 64 of a texturing machine 50 may include covers 72, end plates 74, outer knurling tools 58, and positioners 76. FIG. 11 shows a perspective view of an embodiment of a head 64 of a texturing machine 50. FIG. 12 shows an alternate view of the embodiment of the head 64 of the texturing machine 50 shown in FIG. 11. The covers 72 may be made of polycarbonate, or other transparent material. The covers 72 may allow a user to view the outer knurling tools 58 and the tube 46 during texturing of the tube. The end plates 74 and the covers 72 may keep coolant within the head 64 during formation of a textured tube 48. In the embodiment shown in FIGS. 11 and 12, the head 64 includes three outer knurling tools 58 that are offset by 120° relative to each other. Other embodiments may include fewer or more knurling tools 58. The head may include a positioner 76 for each knurling tool 58.

Positioners 76 of a head 64 may adjust the location of outer knurling tools 58 towards or away from a tube 46 centrally positioned within the head 64. In an embodiment, the positioners 76 may include hydraulically operated height adjustment cylinders. The positioners 76 may be independently adjustable so that a distance between each outer knurling tool 58 and a tube 46 centrally positioned within the head 64 may be independently adjusted. The positioners 76 may also be dependently adjustable so that a distance between a tube 46 centrally positioned in the head 64 and each knurling tool 58 may be simultaneously adjusted. When the positioners 76 are in an initial position, the knurling tools 58 may be offset a distance from a tube 46 that is centrally positioned within the head 64. The distance may allow a tube 46 to be inserted onto the mandrel 60. The distance may also allow a textured tube 48 to be removed from the texturing machine 50. When the positioners 76 are engaged, the outer knurling tools 58 may be moved towards the inner knurling tool 52. The positioners may press the outer knurling tools 58 against a tube 46 positioned over the inner knurling tool 52. The positioners 76 may press the knurling tools 58 against the tube 46 with enough force to press an inner surface 32 of the tube 46 against the inner knurling tool 52.

As shown in FIG. 6, A drive shaft 66 may be coupled to each outer knurling tool 58. Each drive shaft 66 may be coupled to a drive 68. In an embodiment, each drive 68 is an electrically operated motor. The drives 68 may be engaged to rotate the drive shafts 66 and the outer knurling tools 58. The rotating outer knurling tools 58 may texture the outer surface 34 of the tube 46 and propel the tube through the texturing machine 50.

Texturing machine 50 may be used to form a textured tube 48. Cylindrical tubing stock 46 may be placed over the inner knurling tool 52 of the mandrel 60. The tube 46 may be pushed down a length of the mandrel 60 so that the tube is supported by the mandrel and by tube support 62. A portion of the tube 46 may extend beyond the inner and outer knurling tools 52, 58. A portion of the tube 46 may be centrally positioned within the head 64. The inner surface 32 and outer surface 34 of the portion of the tube 46 that extend beyond the knurling tools 52, 58 will not be textured by the machine 50. The drives 68 may be engaged to rotate the outer knurling tools 58. Positioners 76 may be engaged to press the outer knurling tools 58 against the outer surface 34 of the tube 46. Pressing the outer knurling tools 58 against the outer surface 34 of the tube 46 may press the inner surface 32 of the tube against the inner knurling tool 52. Pressing the inner surface 32 against the inner knurling tool may form grooves 36 and ribs 38 in the inner surface of the tube 46. Pressing the outer knurling tools 58 against the outer surface 34 of the tube 46 may form grooves 36 and ribs 38 in the outer surface of the tube.

The rotating outer knurling tools 58 drive the tube 46 through the head 64 so that texturing is formed in the inner and outer surfaces 32, 34 of the tube. The drives 68 may be disengaged to stop the rotation of the outer knurling tools 58 before the outer knurling tool textures an end portion of the tube 46. The drives 68 may be disengaged at a point during the formation of a textured tube 48 when a length of an un-textured portion 78 of a first end of the tube is substantially equal to a length of an un-textured portion 80 of a second end of the tube. The positioners 76 may be disengaged so the positioners return to initial positions. The textured tube 48 may be removed from the texturing machine 50.

Figure 13:
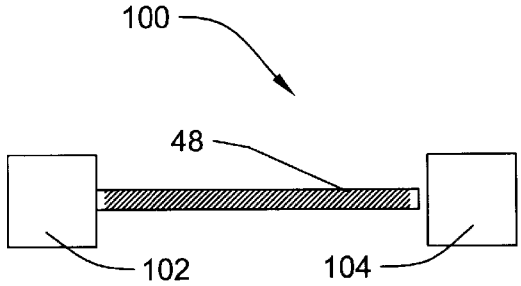
FIG. 13 shows a schematic representation of a pointing machine.

After forming textured inner and outer surfaces 32, 34 of a tube 48, the tube may be pointed. FIG. 13 shows a diagrammatic view of tube pointing machine 100. The tube pointing machine 100 may include drive 102 and die housing 104. The drive 102 may push an end of a textured tube 48 against pointing die 106 that is positioned within the die housing 104. The drive 102 may be, but is not limited to, a hydraulic mechanism or a mechanical mechanism that advances the position of the tube 48 longitudinally into the die housing 104.

Figure 14:
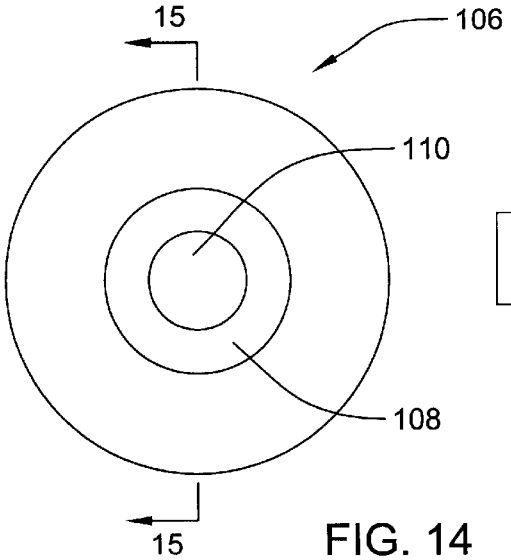
FIG. 14 shows an end view of a tube-pointing die.
Figure 15:
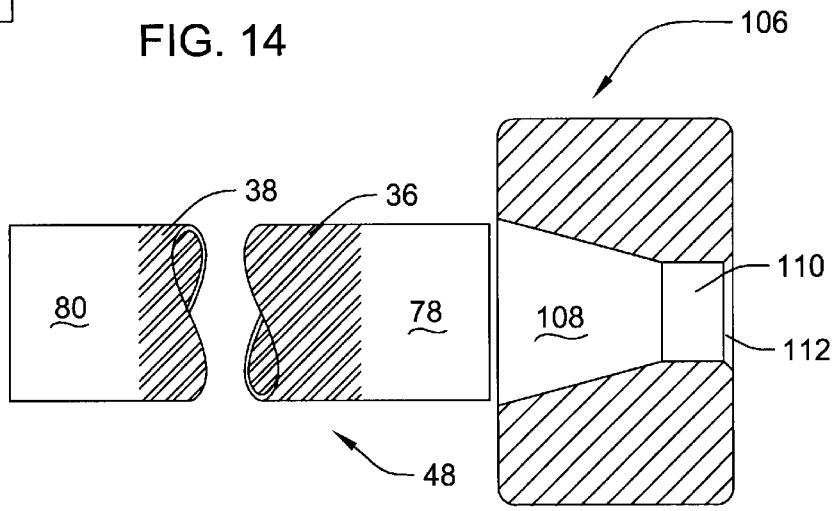
FIG. 15 shows a cross sectional view of a tube-pointing die taken substantially along line 15—15 of FIG. 14 along with a representation of a textured tube.

FIG. 14 shows an end view of pointing die 106. FIG. 15 shows a cross sectional portion of a pointing die 106. A pointing die 106 may have frustro-conical surface 108 that leads to cylindrical opening 110. The cylindrical opening 110 may include a chamfered rear portion 112. The die 106 may be made of a metal having a hardness greater than the hardness of the tubing 48 to be pointed. For example, a stainless steel die 106 may be used as a die material for pointing a textured copper tube 48.

To point a textured tube 48, an end of the tube and a die 106 are pressed together by a drive 102. The drive 102 may be, but is not limited to, a hydraulic mechanism or a mechanical mechanism. The frustro-conical surface 108 of the die 106 may reduce the tube diameter as the tube 48 and die are pressed together. The frustro-conical surface 108 may form frustro-conical portion 82 of textured tube 48. A leading portion of the tube 48 may be forced into the opening 110 of the die 106 by the drive 102. The opening 110 may form cylindrical portions 44 at each end of the tube 48. Each cylindrical portion 44 has a reduced tube diameter as compared to a principal diameter of the tube 48. In an embodiment, the cylindrical portions 44 of the tube 48 are un-textured surfaces. In alternate embodiments, the cylindrical portions 44 may be textured, or partially textured surfaces. The frustro-conical portions 82 of the tube 48 may be textured, partially textured, or un-textured surfaces.

A tube pointer die 106 may be a component of a pointing machine 100. The pointing machine 100 may be a single-end pointing machine, or a double-end pointing machine. FIG. 13 shows a representation of a single-end pointing machine. In an embodiment of a single-end pointing machine 100, the die 106 may be stationary and an end of a tube 48 may be pressed into the die by the drive 102. In an alternate embodiment of a single-end pointing machine 100, the tube 48 may be stationary and the die 106 may be pressed against an end of the tube. The tube 48 may be repositioned in the single-end pointing machine so that the opposite end of the tube may be pointed.

In an embodiment of a double-end pointing machine, two dies 106 may be separated by a distance that allows a tube 48 to be inserted into the machine 100. The machine may be activated to point the ends of a tube 48 positioned between the two dies 106. In an embodiment, the tube 48 is moved against one of the dies 106 to point the first end, and then against a second die to point the second end. In an alternate embodiment, the tube 48 is stationary, and the dies 106 are moved against the ends of the tube to point the tube. A double-end pointing machine may also be formed wherein one of the dies 106 is stationary, and wherein the other die is moveable. A first end of the tube 48 may be pointed by moving the tube into the stationary die. A second end of the tube 48 may be pointed by moving the moveable die against the second end of the tube. Pointing of the first and second ends may be performed substantially simultaneously.

Figure 16:
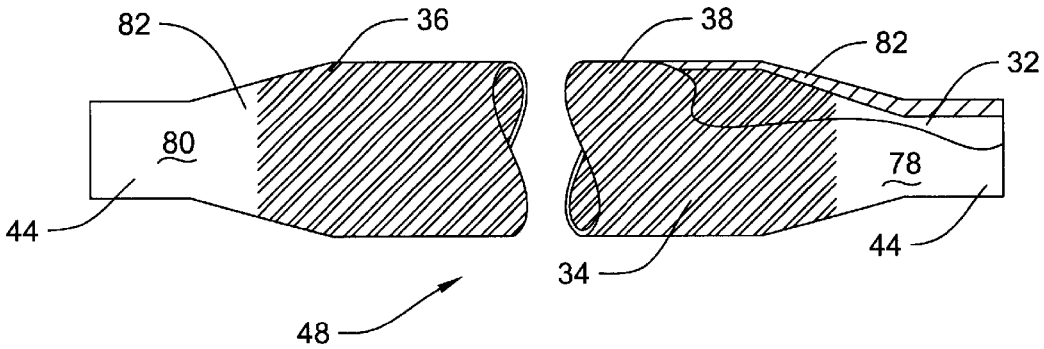
FIG. 16 shows a representation of a pointed tube with a cutout portion that emphasizes the change in wall thickness due to the pointing of the tube.

Pointing a tube 48 may establish a variable wall thickness in the pointed section of the tube. FIG. 16 shows a cross sectional view of an embodiment of a pointed tube 48. A frustro-conical portion 82 of the pointed tube 48 may have a gradually increasing wall thickness. The wall thickness may be least near a large diameter end of the frustro-conical portion 82, and greatest near the reduced diameter cylindrical portion 44. The reduced diameter cylindrical portion 44 may have a substantially constant wall thickness. The wall thickness of the reduced diameter cylindrical portion 44 may be greater than a wall thickness of other portions of the tube 48.

A textured tube 48 may be corrugated to produce a heat exchanger element 30. The textured tube 48 may have reduced diameter cylindrical end portions 44. The corrugations formed in the tube 48 may be linear corrugations or helical corrugations. FIGS. 1 and 2 show representations of heat exchanger elements 30 having linear corrugations. FIGS. 3 and 4 show representations of heat exchanger element 30 having helical corrugations.

Figure 17:
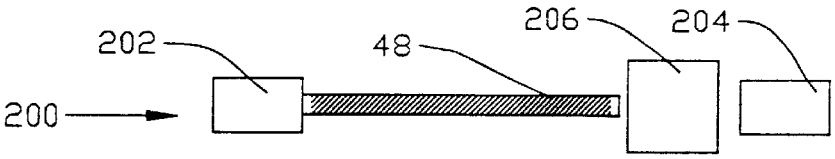
FIG. 17 shows a schematic representation of a corrugating machine.

FIG. 17 shows a schematic representation of corrugating machine 200. The machine may include push drive 202, pull drive 204, and die housing 206. The push drive 202 may push a textured tube 48 into a corrugating die positioned within the die housing 206. The corrugating die may be linearly corrugating die 208 or helically corrugating die 210. A linearly corrugating die 208 may be mounted within the die housing 206 so that the die does not move. A helically corrugating die 210 may be rotatively mounted within the die housing 206. The helically corrugating die 210 may be coupled to a drive mechanism (not shown) that rotates the die when the corrugating machine 200 is forming a heat exchanger element 30. The pull drive 204 may grasp an end of the element 30 as the element emerges from the die housing 206. The pull drive 204 may pull the remaining portion of the tube 48 through the die housing to form a textured and corrugated heat exchanger element 30.

To form a heat exchanger element 30, an end of a textured tube 48 may be positioned at entrance end 212 of a die housing 206. A push drive 202 may contact an opposite end of the tube 48. Engaging the push drive 202 may push the tube 48 into a die 208 or 210 located within the die housing 206. The die 208 or 210 may form a heat exchanger element 30 from the tube 48. A pull drive 204 may grasp the heat exchanger element 30 as the element emerges from the die housing 206. The pull drive 204 may be used to pull the tube 48 into the die 208 or 210 and draw the element 30 out of exit end 214 of the die housing 206.

A corrugating machine 200 may be set up to corrugate textured tubes 48 into either textured, linearly corrugated heat exchanger elements or textured, helically corrugated heat exchanger elements. A pin may be inserted into the machine 200 to inhibit rotational motion of the die during production of textured, linearly corrugated heat exchanger elements. Alternately, separate machines 200 may be set up to corrugate textured tubes 48 into textured, linearly corrugated heat exchanger elements and textured, helically corrugated heat exchanger elements.

Figure 18:
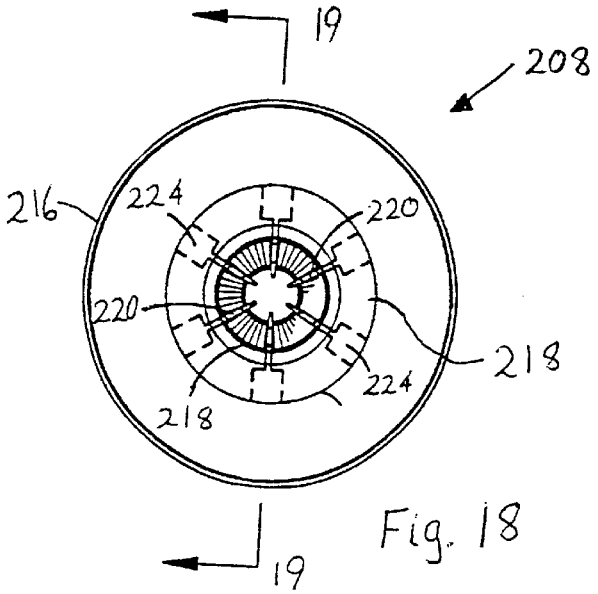
FIG. 18 shows a view of a linearly corrugating die.
Figure 19:
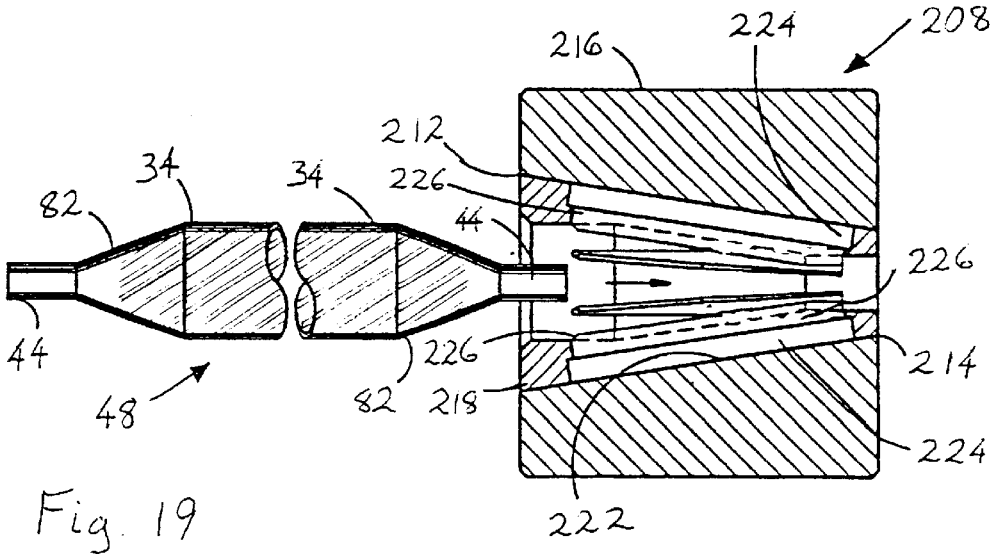
FIG. 19 shows a cross sectional view of the linearly corrugating die taken substantially along line 19—19 of FIG. 18.

FIGS. 18 and 19 show representations of linearly corrugating die 208. The die 208 may include die block 216, die insert 218, and teeth 220. The die block 216 may be cylindrical in shape and may include inner frustro-conical surface 222. The die insert 218 may be configured to fit tightly against the frustro-conical surface 222. Teeth 220 may be positioned within slots of the die insert 218. The teeth 220 may include bases 224 and blades 226. Relative to an outer surface 34 of a tube 48 inserted into the linearly corrugating die 208, the height of the teeth 220 near die entrance end 212 may be low and the height may gradually increase towards exit end 214 of the die 208. The teeth 220 may be spaced above the cylindrical end portions 44 of a textured pointed tube 48 near the exit end 214 of the die 208 so that the die does not corrugate the cylindrical end portions of the tube as the tube is pushed and pulled through the die. The die 208 may be fixedly positioned within a die housing 206 of the corrugating machine 200 during use.

Die insert 218 may include a plurality of slots equidistantly spaced around an upper surface. The slots may hold teeth 220. The die insert 218 shown in FIG. 18 has six slots spaced 60° apart in the die insert. The die insert 218 holds six teeth 220 so that the die 208 produces a heat exchanger element having six lobes 40. Dies having fewer or more slots may be used to form corrugated tubes having fewer or more lobes 40. For example, a die insert 218 may have five teeth placed in five slots that are spaced 72° apart. Such a die would produce a five lobed tube (not shown). A die insert 218 may be formed, or teeth 220 may be inserted into a die insert 218, so that the teeth of the die 208 are not positioned equidistantly about the die insert.

To form a textured, linearly corrugated heat exchanger element 30, a textured tube 48 is positioned near an entrance end 212 of the die 208. A pusher 202 pushes the tube 48 into the die 208. The die teeth 220 indent the outer surface 34 of the tube 48, and the indentions are gradually deepened by the teeth as the tube is pushed further into the die 208. The cylindrical end portion 44 may have a diameter that is small enough to allow the end portion to pass through the die 208 without contacting the blades 226 of the teeth. As a cylindrical end portion 44 of the tube 48 is pushed through the die 208, the end of the tube may be grasped by puller 204. The puller 204 pulls a newly formed heat exchanger element 30 through the die 208.

Figure 20:
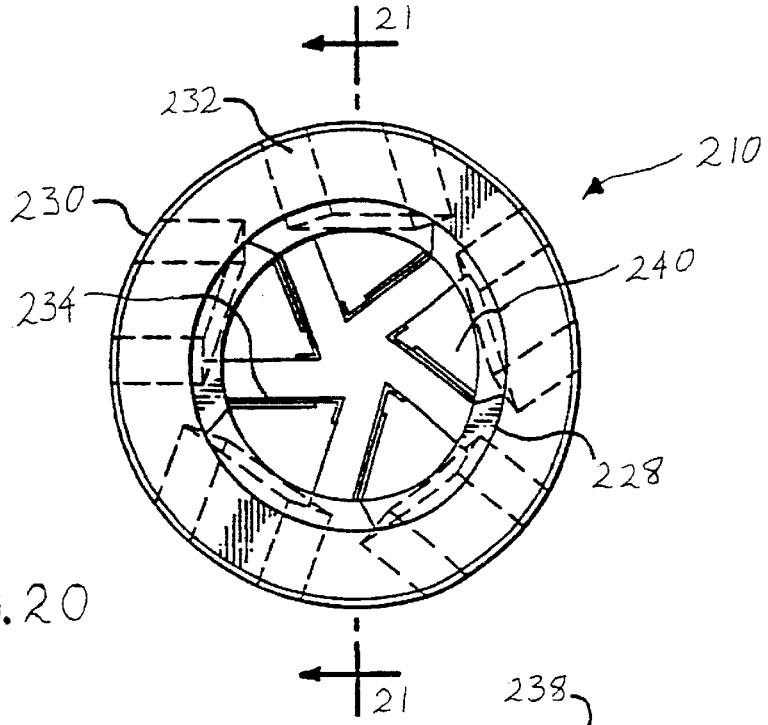
FIG. 20 shows a view of a helically corrugating die.
Figure 21:
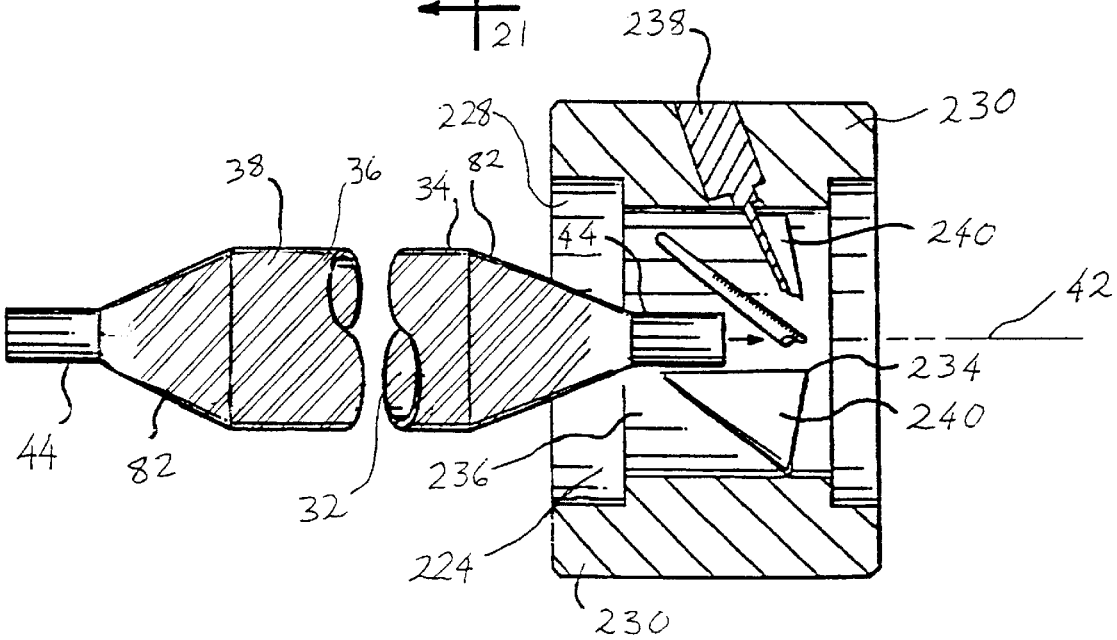
FIG. 21 shows a cross sectional view of the helically corrugating die taken substantially along line 21—21 of FIG. 20.

FIGS. 20 and 21 show representations of die 210 that may be used to form helically corrugated heat exchanger element 30. The die 210 may be rotatively coupled within a corrugating machine 200. During use, the die 210 rotates so that helical lobes 40 are formed in a tube 48 as the tube is moved through the die. The die 210 may include bushing seat 228, body 230, slotted blade holders 232, and a plurality of removable teeth 234. The bushing seat 228 may allow various sizes of bushings (not shown) to be installed in the die 210. The bushing may include a frustro-conical inner surface configured to guide a particular diameter of textured tube 48 into the die 210.

The body 230 may include longitudinally extending bore 236. Removable teeth 234 may be placed in the blade holders 232 so that portions of the teeth extend radially inward into the bore 236. The teeth 234 may include base portions 238, which fit within the blade holders 232. The blade holders 232 may be equidistantly placed around a circumference of the bore 236.

The teeth 234 may also include blades 240 that extend into the bore 236 both radially and at an angle to a longitudinal axis 42 of the bore. FIG. 20 shows a die with five teeth 234. A die 210 with fewer or more teeth 234 may be used to form a heat exchanger element 30 having fewer or more helical lobes 40. The number of teeth 234 used to helically corrugate a textured tube 48, which began as cylindrical tubing stock 46 having a 1 ½ inch diameter, may be from three to twelve teeth, and may preferably be from five to eight teeth. A height of the blades 240 relative to the bore 236 may vary axially along a length of the bore. The height of the blades 240 relative to the bore 236 may be least near entrance end 212 of the die 210. The height of the blades 240 relative to the bore 236 may be greatest near exit end 214 of the die 210. The blades 240 may be spaced above the cylindrical end portions 44 of a textured pointed tube 48 near exit end 214 of the die 210 so that the die does not corrugate the cylindrical end portions of the tube as the tube is pushed and pulled through the die 210.

After a heat exchanger element 30 is formed in a corrugating machine 200, the element may be passed through reducing die 300 or a shape altering die. A shape altering die may be a Turk's Head, such as shown in FIGS. 12 and 13 of U.S. Pat. No. 5,409,057. The Turk's Head may produce an element 30 having a generally square or rectangular cross sectional shape.

Figure 22:
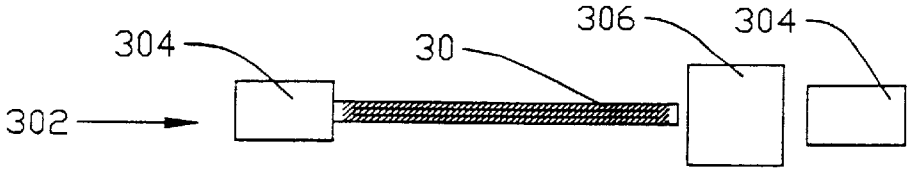
FIG. 22 shows a diagrammatic illustration of a reduction machine.
Figure 23:
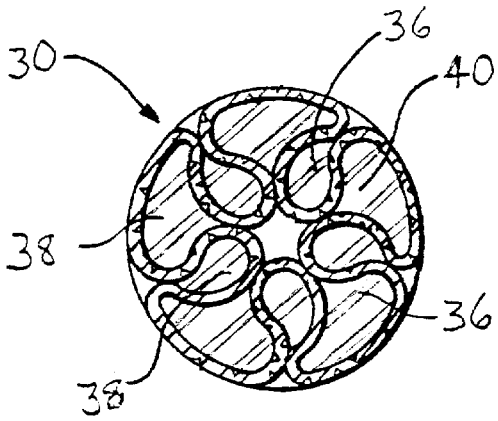
FIG. 23 shows a cross sectional view of a textured, helically corrugated heat exchanger element after the element has passed through a reducing die.

A reducing die 300 may be coupled to an exit end of the corrugating machine 200, or the reducing die may be part of a separate reduction machine 302. FIG. 22 shows a diagrammatic representation of a reduction machine 302. The reducing die 300 may reduce the largest diameter of the element 30 and compress the lobes 40 of the element together. FIG. 23 shows a cross sectional view of a five-lobed helically corrugated element 30 that has been passed through a reducing die 300. The passage of an element 30 through a reducing die 300 may reduce or eliminate some of the texturing on an outer surface 34 of the element.

Figure 24:
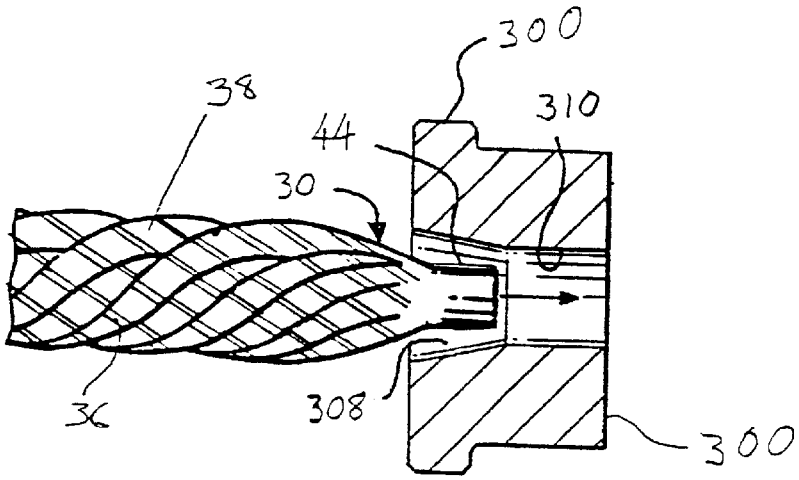
FIG. 24 shows a cross sectional view of a reduction die with a textured, helically corrugated heat exchanger element positioned at an entrance to the die.

A reduction machine 302 may include a pair of drive mechanisms 304 and die housing 306. A first portion of the drive mechanism 304 may push an element 30 into the die housing 306, and then, a second portion of the drive mechanism grasp the element and pull the element through the die housing. The die housing 306 may hold a reducing die 300. FIG. 24 shows a cross sectional view of a reducing die 300. The reducing die 300 may include frustro-conical surface 308 that reduces a diameter of an element 30 as the element is pushed and/or pulled through the reducing die. The reducing die 300 may also include cylindrical surface 310 that has a diameter equal to a desired diameter of an element 30.

Figure 25:
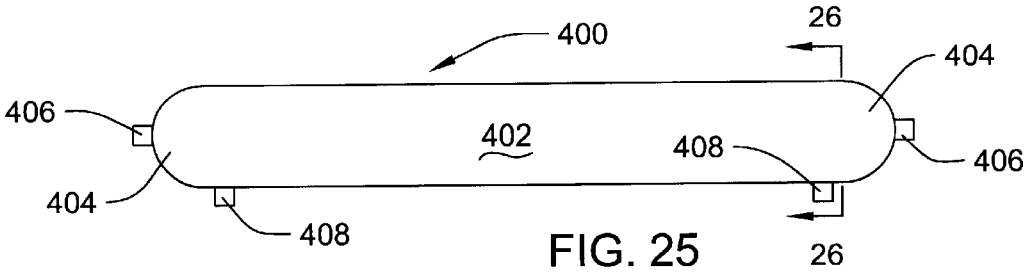
FIG. 25 shows a front view of a tube-in-shell heat exchanger.
Figure 26:
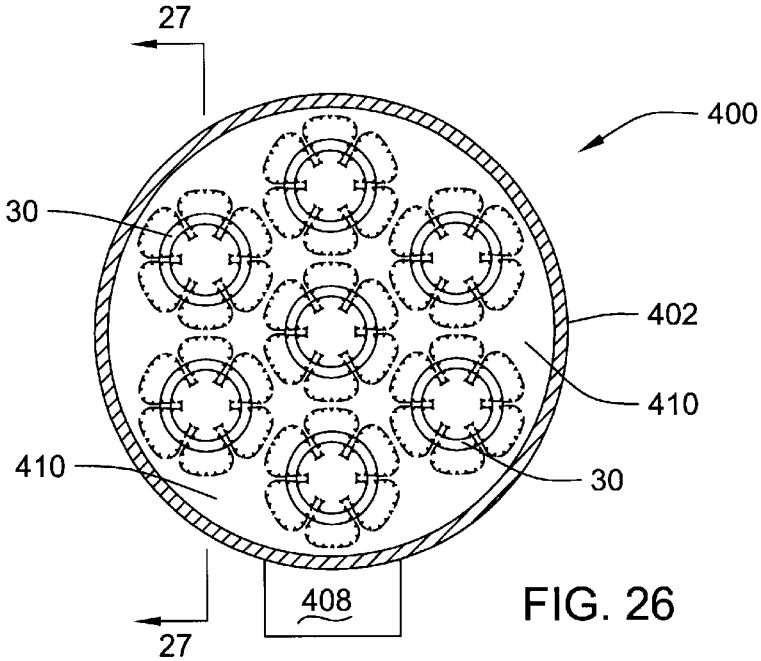
FIG. 26 shows a cross sectional view of the heat exchanger taken substantially along line 26—26 of FIG. 25.
Figure 27:
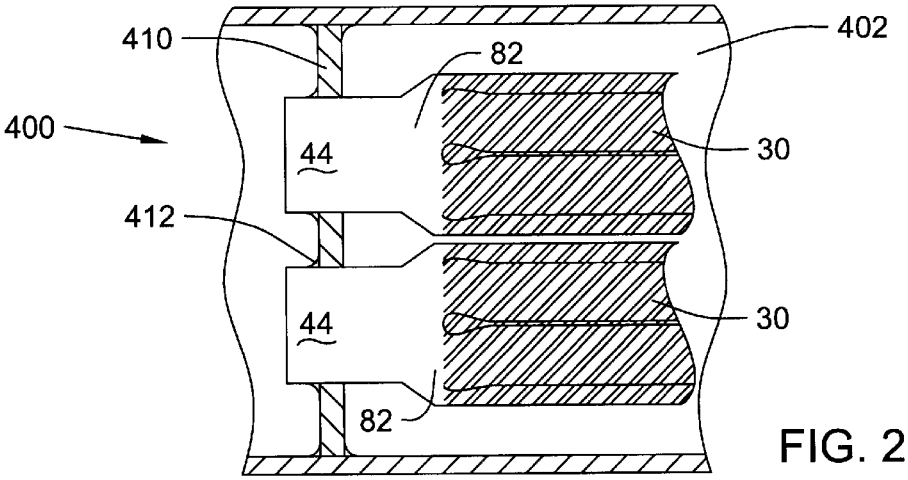
FIG. 27 shows a partial cross sectional view of the heat exchanger taken substantially along line 27—27 of FIG. 26, wherein the textured tubes are not shown in cross section.

A textured, corrugated heat exchanger element 30 with un-textured, reduced diameter cylindrical portions 44 may be used as an element within heat exchanger 400. FIG. 25–27 show an embodiment of a tube-in-shell heat exchanger 400 that uses textured, linearly corrugated heat exchanger elements 30. A heat exchanger may also be made using textured, helically corrugated heat exchanger elements. A heat exchanger 400 may include shell 402, heat exchanger elements 30, end caps 404, first fluid lines 406, second fluid lines 408, and spacers (not shown). The first fluid lines 406 and the second fluid lines 408 may be input and output lines for heat exchange fluids. The lines 406, 408 may be coupled to heat exchanger fluid lines so that the heat exchanger 400 has a co-current or a counter-current fluid flow arrangement. The type of flow arrangement may be chosen based upon the specific requirements needed for a heat transfer system. The fluids flow substantially parallel to longitudinal axes of the heat exchanger elements 30. Spacers positioned between the shell 402 and the elements 30 may reduce the amount of space between the shell 402 of the heat exchanger 400 and the elements 30. The spacers may reduce the amount of space between the adjacent tubes to inhibit fluid channeling within the spaces.

Heat exchanger elements 30 may be coupled to support structures 410 within a shell 402 of a heat exchanger 400. The support structures 410 may be tube sheets. The heat exchanger elements 30 and the support structures 410 inhibit mixing of a first heat exchange fluid, which passes through the elements, and a second heat exchanger fluid, which passes around the elements. FIG. 26 shows a sectional view of a tube-in-shell heat exchanger 400 wherein the support structure 410 is a tube sheet. If the elements 30 did not have un-textured cylindrical portions 44, the textured and corrugated outer surfaces of the elements would need to be sealed to the support structure 410. The close spacing of the elements 30, the geometry of the elements, and the texturing of the elements would make sealing the elements to the support structure a difficult and time consuming task. The un-textured, reduced diameter cylindrical portions 44 may allow the elements 30 to be easily sealed to the support structure 410 of the heat exchanger 400. Elements 30 may be sealed to a support structure 410 by several different methods; including, but not limited to, welding and application of a sealant.

FIG. 27 shows a cross sectional view of a portion of a heat exchanger 400. Un-textured, reduced diameter sections 44 of the heat exchanger elements 30 are sealed to the support structure 410 by welds 412. The increased wall thickness of the un-textured, reduced diameter sections 44 and the geometry of the elements 30 may provide strength and support for the elements 30 and the heat exchanger 400.

A textured, corrugated heat exchanger element 30 may have improved heat exchanger properties as compared to a corrugated heat exchanger element that has smooth inner and outer surfaces. A first condenser was made with a 6-lobed corrugated heat exchanger element without texturing. A second condenser was made with a 6-lobed, textured heat exchanger element 30 having substantially the same diameter, length and wall thickness of the tube used for the first condenser. The following table lists some of the properties of the condensers obtained during a comparison experiment using water on one side of the heat exchanger elements and refrigerant R-22 on the other side of the heat exchanger elements. The textured, heat exchanger element 30 had an increased overall heat transfer coefficient of about $[(1332/840)-1]\times100=59\%$ over the untextured heat exchanger element. A greater increase in the overall heat coefficient may be expected for a heat exchanger element 30 as compared to a cylindrical tube heat exchanger element of substantially equivalent effective diameter.

| Condenser | 1 | 2 |
|---|---|---|
| Water flow rate (gpm) | 3.65 | 3.65 |
| Water side pressure drop (psi) | 4.47 | 5.41 |
| Entering water temperature (° F.) | 85 | 85 |
| Exit water temperature (° F.) | 95 | 95 |
| Saturated condensing temperature for R-22 side (° F.) | 112.1 | 104.3 |
| Subcooling (° F.) | 15 | 15 |
| Condenser capacity (Btu/hr) | 18,250 | 18,250 |
| Log mean temperature difference (° F.) | 21.72 | 13.70 |
| Heat transfer coefficient (Btu/(hr ft$^2$ ° F.)) | 840 | 1332 |

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A heat exchanger element comprising:

a seamless conduit;

corrugations formed in a section of the conduit, wherein the section extends for greater than a majority of the length of the conduit, wherein the corrugations comprise two or more indentions that form convolutions in the conduit, wherein the convolutions extend along a length of the section, and wherein a periphery of the conduit along the length of the section is substantially constant;

texturing formed in an interior surface of the conduit; and texturing formed in an exterior surface of the conduit.

2. The heat exchanger element of claim 1, wherein the corrugations formed in the conduit are linear corrugations.

3. The heat exchanger element of claim 1, wherein the corrugations formed in the conduit are helical corrugations.

4. The heat exchanger element of claim 1, wherein the conduit comprises between 2 and 21 corrugations formed in the conduit.

5. The heat exchanger element of claim 1, wherein the conduit comprises between 4 and 9 corrugations formed in the conduit.

6. The heat exchanger element of claim 1, further comprising a cylindrical end portion at an end of the conduit.

7. The heat exchanger element of claim 1, further comprising cylindrical end portions at each end of the conduit.

8. The heat exchanger element of claim 1, further comprising a cylindrical end portion at an end of the conduit, wherein a section of the cylindrical end portion comprises an un-textured outer surface.

9. The heat exchanger element of claim 1, wherein the texturing in the interior surface comprises a plurality of grooves.

10. The heat exchanger element of claim 1, wherein the texturing in the exterior surface comprises a plurality of grooves.

11. The heat exchanger element of claim 1, wherein the texturing in the interior surface comprises a plurality of angled grooves in a clockwise orientation with respect to a longitudinal axis of the conduit, and wherein the texturing in the exterior surface comprises a plurality of angled grooves in a counter clockwise orientation with respect to the longitudinal axis of the conduit.

12. The heat exchanger element of claim 1, wherein the texturing in the interior surface comprises a plurality of angled grooves in a counter clockwise orientation with respect to a longitudinal axis of the conduit, and wherein the texturing in the exterior surface comprises a plurality of angled grooves in a clockwise orientation with respect to the longitudinal axis of the conduit.

13. The heat exchanger element of claim 1, wherein a height of the ribs formed in the inner surface of the conduit is less than about 0.035 inches, and greater than about 0.004 inches.

14. The heat exchanger element of claim 1, wherein a height of the ribs formed in the inner surface of the conduit is less than about 0.025 inches, and greater than about 0.004 inches.

15. The heat exchanger element of claim 1, wherein a height of the ribs formed in the inner surface of the conduit is less than about 0.020 inches, and greater than about 0.004 inches.

16. The heat exchanger element of claim 1, wherein a height of the ribs formed in the outer surface of the conduit is less than about 0.035 inches, and greater than about 0.004 inches.

17. The heat exchanger element of claim 1, wherein a height of the ribs formed in the outer surface of the conduit is less than about 0.025 inches, and greater than about 0.004 inches.

18. The heat exchanger element of claim 1, wherein a height of the ribs formed in the outer surface of the conduit is less than about 0.020 inches, and greater than about 0.004 inches.

19. The heat exchanger element of claim 1, wherein the texturing in the interior surface and the texturing in the exterior surface comprises a crosshatched pattern.

20. A system for producing a corrugated heat exchanger element having grooved interior and exterior surfaces, comprising:

a texturing machine, the texturing machine comprising:

an internal knurling tool configured to form a pattern of grooves in an inner surface of a tube;

an external knurling tool configured to form a pattern of grooves in an outer surface of the tube; and a corrugating machine configured to corrugate a section of the tube, wherein corrugations formed by the corrugating machine in the section comprise two or more indentions in the outer surface of the tube that extend along a length of the tube to form convolutions in the tube.

21. The system of claim 20, wherein the corrugating machine forms linear corrugations.

22. The system of claim 20, wherein the corrugating machine forms helical corrugations.

23. The system of claim 20, wherein the corrugating machine forms between 2 and 21 corrugations.

24. The system of claim 20, wherein the corrugating machine forms between 4 and 9 corrugations.

25. The system of claim 20, further comprising a pointing machine configured to form a cylindrical end portion in the element.

26. The system of claim 20, further comprising a reducing machine configured to reduce an outermost diameter of the element.

27. The system of claim 20, wherein the inner knurling tool forms grooves in the inner surface of the tube that have a depth greater than about 0.004 inches and less than about 0.035 inches.

28. The system of claim 20, wherein the inner knurling tool forms grooves in the inner surface of the tube that have a depth greater than about 0.004 inches and less than about 0.025 inches.

29. The system of claim 20, wherein the inner knurling tool forms grooves in the inner surface of the tube that have a depth greater than about 0.004 inches and less than about 0.020 inches.

30. The system of claim 20, wherein the outer knurling tool forms grooves in the outer surface of the tube that have a depth greater than about 0.004 inches and less than about 0.035 inches.

31. The system of claim 20, wherein the outer knurling tool forms grooves in the outer surface of the tube that have a depth greater than about 0.004 inches and less than about 0.025 inches.

32. The system of claim 20, wherein the outer knurling tool forms grooves in the outer surface of the tube that have a depth greater than about 0.004 inches and less than about 0.020 inches.

33. The system of claim 20, wherein the outer knurling tool and the inner knurling tool form a crosshatched texturing pattern in the inner and outer surfaces of the tube.

34. A method of producing a heat exchange element, comprising:

forming texturing in an inner surface of a conduit;

forming texturing in an outer surface of the conduit; and corrugating a section of the conduit to form corrugations in the conduit, wherein the corrugations comprise two or more indentions in the outer surface of the conduit that extend along a length of the section to form lobes in the conduit.

35. The method of claim 34, wherein forming texturing in the inner surface of the conduit comprises forming a plurality of grooves in the inner surface.

36. The method of claim 34, wherein forming texturing in the outer surface of the conduit comprises forming a plurality of grooves in the outer surface.

37. The method of claim 34, wherein forming texturing in the inner surface of the conduit happens substantially simultaneous with forming texturing in the outer surface of the conduit.

38. The method of claim 34, wherein the grooves formed in the exterior surface of the conduit are substantially coaxial to a longitudinal axis of the conduit prior to forming corrugations in the conduit.

39. The method of claim 34, wherein the corrugations in the conduit are linear corrugations.

40. The method of claim 34, wherein the corrugations in the conduit are helical corrugations.

41. The method of claim 34, further comprising forming a reduced diameter length of cylindrical tubing at an end of the conduit.

42. The method of claim 34, further comprising forming a reduced diameter length of cylindrical tubing at an end of the conduit, wherein an outer surface of the cylindrical tubing is not textured.

43. The element formed by the method of claim 34.

44. A heat exchanger comprising, a shell;

a pair of support structures within the shell;

heat exchanger elements sealed to the support structures, wherein interior surfaces and exterior surfaces of a plurality of the heat exchanger element are textured; wherein texturing of the exterior surfaces of the plurality of the heat exchanger elements comprises grooves spaced around outer peripheries of the heat exchanger elements and extending along portions of lengths of the heat exchanger elements, wherein the plurality of the heat exchanger elements comprise corrugations, wherein the corrugations of a heat exchanger element comprise two or more indentions in a section of the exterior surface of the heat exchanger element, and wherein the indentions extend along a length of the section to form lobes in the heat exchanger element;

a first fluid inlet and a first fluid exit configured to direct a first fluid through the heat exchanger elements; and a second fluid inlet and a second fluid outlet configured to direct a second fluid past the exterior surfaces of the heat exchanger elements.

45. The heat exchanger of claim 44, wherein end portions of the heat exchanger elements comprise cylindrical portions.

46. The heat exchanger of claim 44, wherein the corrugations of at least one of the heat exchanger elements are linear corrugations.

47. The heat exchanger of claim 44, wherein the corrugations of at least one of the heat exchanger elements are helical corrugations.

48. The heat exchanger of claim 44, wherein the texturing in the interior surface of the heat exchanger elements comprises grooves.

49. The heat exchanger of claim 44, wherein the second fluid is directed substantially parallel to longitudinal axes of the heat exchanger elements.

* * * * *